United States Patent [19]

Leonard

[11] 3,999,272

[45] Dec. 28, 1976

[54] WIRING REMOVAL TOOL

[75] Inventor: Donald Henry Leonard, Aurora, Ill.

[73] Assignee: Bell Telephone Laboratories, Incorporated, Murray Hill, N.J.

[22] Filed: Nov. 24, 1975

[21] Appl. No.: 634,483

[52] U.S. Cl. ..... 29/203 H; 29/200 D; 29/203 B; 81/3 R

[51] Int. Cl.[2] ..... H01R 43/00

[58] Field of Search ..... 29/203 B, 203 H, 203 HM, 29/203 MW, 200 D; 81/3 R, 3 J

[56] References Cited

UNITED STATES PATENTS 3,946,476 3/1976 Mason ..... 29/203 H

*Primary Examiner*—Carl E. Hall

*Attorney, Agent, or Firm*—William H. Kamstra

[57] ABSTRACT

A tool to facilitate the removal of individual leads underlying others in wiring layers of a backplane terminal pin field. In the past, wiring being removed was frequently pulled against overlying leads causing damage to insulation and even breakage. The tool is provided with sockets to fit over a number of terminal pins for accurate positioning and the lead to be removed is drawn against a guide portion which takes the strain rather than the overlying wiring.

5 Claims, 3 Drawing Figures

WIRING REMOVAL TOOL

BACKGROUND OF THE INVENTION

This invention relates to electrical wiring apparatus and more particularly to devices and tools for effecting changes in electrical wiring interconnections.

The backplane wiring of particular components of many electrical systems frequently presents a complicated maze of crisscrossing leads and terminal pins. The terminal pins are usually placed in closely spaced rows and columns, and wiring lying in a number of layers between the rows and columns of pins as the individual leads make their connections among the pins. The leads being suitably insulated, this arrangement would present no problems should no changes ever be necessary in the terminal pin interconnections. It will be appreciated, however, that for a number of reasons, wiring changes may be called for after an initial or subsequent wiring scheme has been established. In the past, a wiring change was accomplished by unwrapping the affected lead or leads from the pins at the lead ends and simply withdrawing each lead from the wiring array by means of a suitable grasping tool. This, of course, is readily done when the leads to be withdrawn lie in the outer wiring layer. When part of an underlying layer, however, a lead in the past could only be withdrawn by pulling it against one or more leads of overlying wiring. The stress thus created on overlying wiring frequently led to stripped and nicked insulation, and even broken leads, necessitating a costly and time-consuming search for the damaged leads and their replacement. Accordingly, it is an object of this invention to provide a simple and economical tool to facilitate the selective removal of leads from among others in a complex terminal pin wiring array.

SUMMARY OF THE INVENTION

The foregoing and other objects of this invention are realized in one specific embodiment thereof comprising a tool adapted to fit over two or more terminal pins at the point of a wiring array where a lead is to be removed. A base portion of the tool so located is provided with a guide adapted to fit over the lead to be removed, the pins being insertable into the base portion to a depth sufficient to hold the lead out of contact with any overlying leads of the wiring array. The tool may be manually maintained in this position by a handle provided thereon while the previously disconnected lead is drawn out of the array against the lead guide. As the lead is snaked out from overlying wiring, contact with the latter is either prevented or minimized to the point where no damage can be caused.

A simple and readily fabricated tool is thus provided according to this invention which at once advantageously locates the lead to be removed, presents a bearing surface for its removal, and prevents interference with other leads and their possible damage.

BRIEF DESCRIPTION OF THE DRAWING

The construction and operation of a tool according to the principles of this invention will be better understood from a consideration of the detailed description of one illustrative embodiment thereof which follows when taken in conjunction with the accompanying drawing in which.

DETAILED DESCRIPTION

Figure 1:
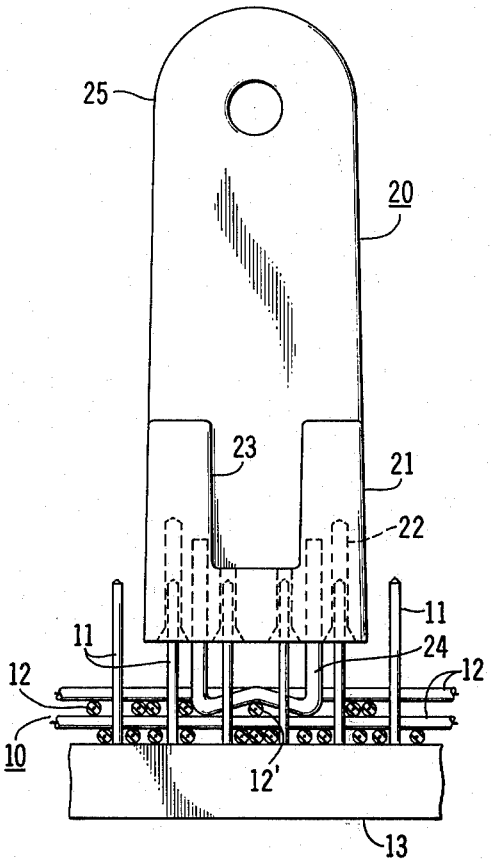
FIGS. 1 through 3 show front, side, and end views, respectively, of an illustrative tool in association with a portion of a typical terminal pin wiring array, FIG. 2 showing in partial section view the fitting of the pins and manner of operation.

An illustrative electrical lead removal tool according to this invention is shown in front view in FIG. 1 as positioned in place in association with a representative portion of a typical terminal pin wiring array 10. The array, as is known, comprises a plurality of pins 11 evenly spaced in rows and columns, along and between which layers of leads 12 are arranged which make interconnections with the pins 11, specific interconnections not being shown. The pins 11 are suitably mounted on a suitable backplane structure 13 and it is assumed for purpose of description that the lead 12′ is to be removed from between its over- and underlying wiring layers. Accordingly, the tool 20 is shown positioned at that point in the wiring array where the lead 12′ passes between adjoining pins 11.

Figure 3:
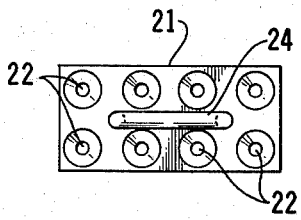

A base portion 21 of tool 20 is provided with a plurality of holes 22 which are dimensioned and spaced to act as snug-fit sockets for the pins 11. The arrangement of holes in the base portion 22 of tool 20 is better seen in the end view of FIG. 3 which also shows the holes as having chamfered edges to facilitate entry of the pins. This entry and prior alignment is further facilitated by a recess 23 in the base portion 21 making possible a sighting of at least two pins from the other ends of the holes 22 to be aligned. Although eight alignment holes 22 are shown in the illustrative tool 20, it will be appreciated that more or fewer such holes may be provided as required to ensure a positive positioning of the tool in a terminal pin field. The holes 22 are shown as being circular in the drawing; as such they may accommodate pins of either circular or other cross-section. The holes 22 may equally well be formed to agree with any non-circular pin cross-section; in any case, they are of sufficient depth to permit a reach to the leads of the nethermost wiring layer by the operative element of the tool 20.

Figure 2:
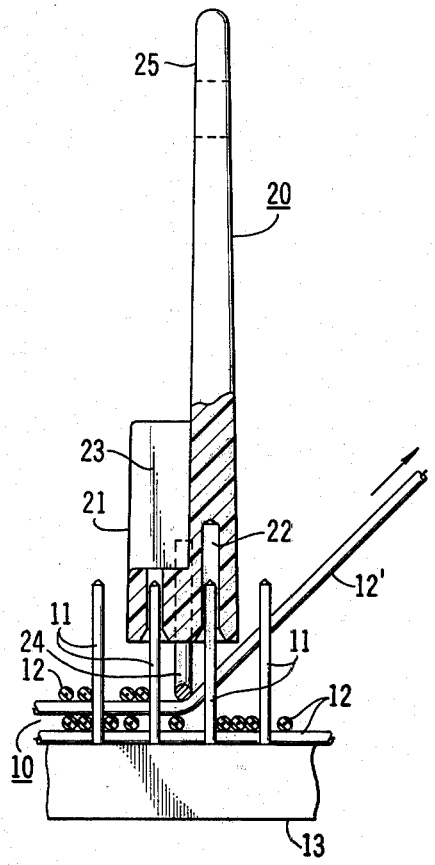

This operative element comprises a guide 24 formed, in the illustrative embodiment being described, of a wire in a substantially U-shape having its upwardly extending legs embedded in the base portion 21 of tool 20. The base of the guide 24 is crimped slightly upward as viewed in the drawing to receive the lead 12′ to be removed, the crimped portion being aligned with adjoining pins to seat over the lead 12′ substantially a midpoint of adjoining pin pairs. This location is seen in FIG. 1 as the midpoint between two pins of a row of pins and in the side view of FIG. 2 as the midpoint between two pins of a column of pins. Remaining with FIG. 2, the ultimate function of the tool 20 is there also more clearly seen. In the side view, the guide 24 maintains the lead 12′ to be removed in place beneath its overlying wiring layer up to the midpoint of the adjoining terminal pins 11. The partial section view of FIG. 2 also clearly shows the association of the base portion 21 with the inserted pins. A handle 25 completes the structure of the tool 20 which handle may be conveniently apertured for storage purposes. With the tool 20 positioned in a backplane terminal pin field as described, the lead 12′ is now readily withdrawn from between the wiring layers against the guide 24 by drawing on the lead 12′ in the direction as indicated by the arrow in FIG. 2.

A simple tool has thus been described which is readily and economically fabricated by known molding techniques. It will be appreciated that various modifications may be devised by one skilled in the art without departing from the spirit and scope of the invention. Thus, for example, if the tool is fabricated by molding, the guide portion 24 may be formed integrally with the base portion 21 as a tab having the general profile as that described. The scope of this invention is thus to be understood as limited only as defined in the accompanying claims.

What is claimed is:

1. A device for facilitating the removal of electrical leads from among others in a wiring and terminal pin array, said device comprising a base portion having a plurality of sockets dimensioned and spaced to receive, respectively, a plurality of terminal pins of said array, a guide extending from said base portion at one end having an edge presenting an indentation to fit over and maintain a lead being removed in a fixed path relative to other leads in said array, and a handle extending from said base portion at the other end for manually positioning said device.

2. A device as claimed in claim 1 in which said guide comprises a wire formed in a substantially U-shape having its legs embedded in said base portion and having as said indentation its base crimped to fit said lead being removed.

3. A device as claimed in claim 1 in which said base portion is recessed to permit sighting through at least one of said sockets.

4. A device for facilitating the removal of electrical leads from among others in a wiring and terminal pin array, said device comprising a flat handle member having a raised portion at one end, said raised portion having a plurality of sockets in axes parallel with the longitudinal axis of said handle member and extending partially through said raised portion, said sockets being dimensioned and spaced to receive, respectively, a plurality of terminal pins of said array, and a guide extending from said raised portion having an edge presenting an indentation for partially encompassing and maintaining a lead being removed in a fixed path relative to other leads in said array.

5. A device as claimed in claim 4 in which said raised portion is recessed to expose at least one of said sockets.

* * * * *